United States Patent [19]

Hatanaka

[11] 4,231,530

[45] Nov. 4, 1980

[54] AUTOMATIC DOCUMENT SHREDDER

[76] Inventor: Takefumi Hatanaka, No. 276-19, Higashihiraga, Matsudo-shi, Chiba-ken, Japan

[21] Appl. No.: 972,471

[22] Filed: Dec. 22, 1978

[30] Foreign Application Priority Data

Nov. 15, 1978 [JP] Japan ..... 53-139772

[51] Int. Cl.[3] ..... B02C 18/22

[52] U.S. Cl. ..... 241/223; 241/285 A; 271/9; 271/35

[58] Field of Search ..... 83/29, 417, 436, 401; 221/34, 93, 94, 119, 123, 124; 271/9, 171, 35, 223; 241/34, 222, 223, 235, 236, 227, 285 R, 224, 285 A

[56] References Cited

U.S. PATENT DOCUMENTS 3,598,395 8/1971 Carriero et al. ..... 271/9 X

FOREIGN PATENT DOCUMENTS 2717522 10/1978 Fed. Rep. of Germany ..... 241/223

738866 10/1955 United Kingdom ..... 271/9

*Primary Examiner*—Mark Rosenbaum

*Attorney, Agent, or Firm*—Robert E. Burns; Emmanuel J. Lobato; Bruce L. Adams

[57] ABSTRACT

An automatic document disintegrator has a stand-by chamber into which waste documents to be processed are placed and a paper feed mechanism having engaging members for feeding to a shredding section the waste documents placed in said stand-by chamber. The stand-by chamber is divided by detachable partitioning members into a plurality of compartments corresponding to the sizes of the waste documents, and the engaging members project into each of the compartments and simultaneously feed a prescribed number of sheets of the waste documents placed in each of the compartments to the shredding section in a batch-wise manner.

7 Claims, 6 Drawing Figures

AUTOMATIC DOCUMENT SHREDDER

This invention relates to a document disintegrator and more particularly to an automatic document shredder for shredding various kinds of waste documents, paper sheets, drawings and the like into unintelligible form.

Conventional document shredders are poor in processing efficiency since waste documents must be destroyed by manually feeding only a prescribed number of sheets into the shredder inlet, with a separate operation required for each batch of documents of the prescribed number. When a large number of sheets are to be processed, such a shredder occupies an exorbitant amount of the operator's time. This is extremely uneconomical in view of today's high cost of labor. Another difficulty is that the shredder motor is subjected to an excessive load and is thus likely to cease operating during use of the shredder when too many sheets of waste documents are fed into the shredder inlet.

In order to enhance processing efficiency, a method has been developed in which a feed belt provided at the side of the shredder inlet is adapted to convey waste documents to the inlet. However, this apparatus is inconvenient since the operator is still required to place required numbers of waste documents on the feed belt through a separate operation for each batch.

It is, therefore, an object of the present invention to provide a document shredder which provides an extremely high processing efficiency.

It is another object of the present invention to provide an automatic document shredder adapted to automatically convey a given number of sheets of waste documents to a shredding section in a batch-wise manner.

It is a further object of the present invention to provide an automatic document shredder adapted to automatically convey a given number of sheets of identically or differently sized waste documents to a shredder section simultaneously and in a batch-wise manner.

Figure 1:
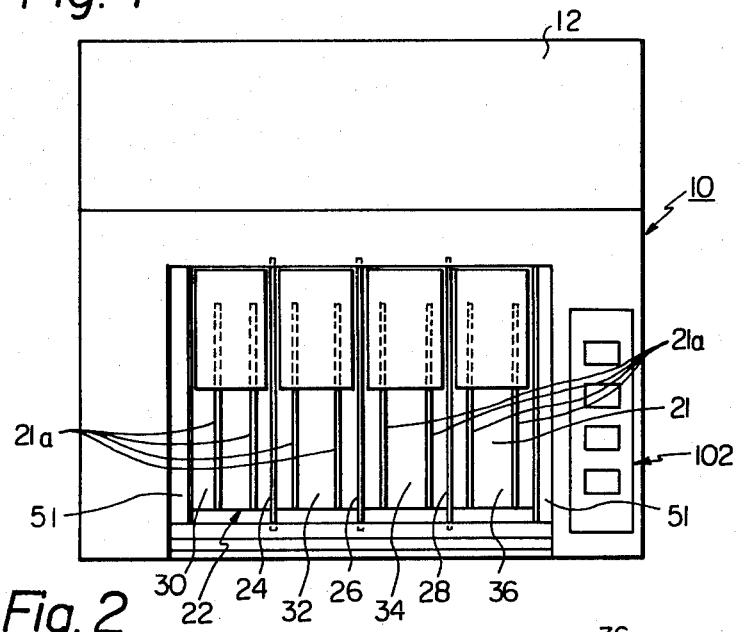
FIG. 1 is a plan view of a preferred embodiment of an automatic document shredder according to the present invention.
Figure 2:
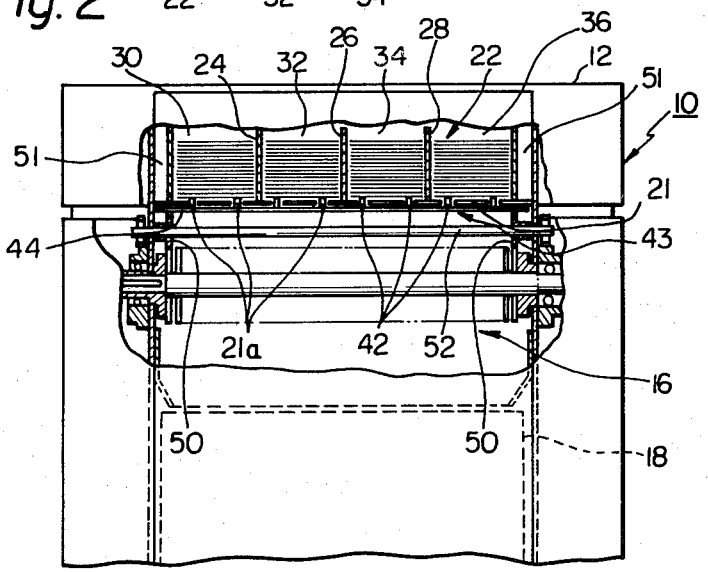
FIG. 2 is a front view of the document shredder shown in FIG. 1 with a portion thereof cut away.
Figure 3:
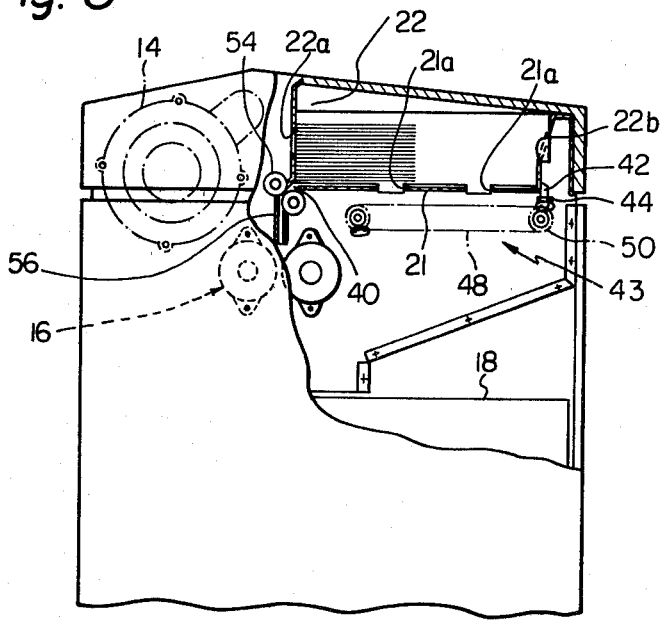
FIG. 3 is a side view of the document shredder shown in FIG. 2 with a portion thereof cut away.
Figure 4:
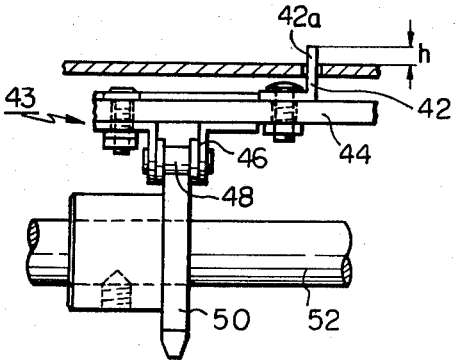
FIG. 4 is an enlarged view showing the relationship between the platform and engaging members illustrated in FIG. 2.
Figure 5:
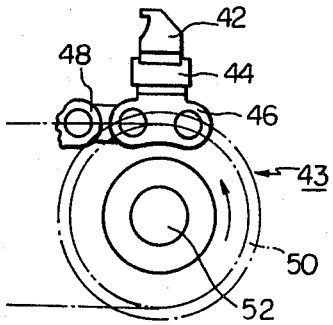
FIG. 5 is an enlarged side view of the engaging members as well as the relationship between the engaging members and the drive section as illustrated in FIG. 4.

Referring now to FIGS. 1, 2 and 3, an automatic document shredder 10 according to the present invention has a casing 12 which houses a drive motor 14, a shredder section 16 for shredding waste documents into unintelligible form, and a tray 18 for receiving the chips or fragments which result when the waste documents are shredded. The shredding section 16 may be of any suitable type and is shown, in this embodiment, as comprising a plurality of cutter disks by way of example. Casing 12 also has a stand-by chamber 22 having a platform 21 onto which a large quantity of waste documents is placed at one time for processing. Stand-by chamber 22 is provided with a plurality of detachable partitioning members 24, 26, 28 arranged in parallel to the direction in which the documents are conveyed and adapted to divide the stand-by chamber into a plurality of compartments 30, 32, 34 and 36 which correspond to the sizes of the waste documents to be placed in each of the compartments on the platform. Each of detachable partioning members 24, 26, 28 also serves as a guide means to guide the waste documents so as to prevent interference of waste documents placed in respective compartments, thereby achieving smooth flow of prescribed numbers of sheets of the waste documents placed in the respective compartments to the shredding section 16. Formed on platform 21 in parallel with the partitioning members are guideways comprising elongated slots 21*a* each opening in a respective one of the compartments 30, 32, 34, 36. Projecting through the slots 21*a* into each of the compartments are engaging members 42 that engage with a prescribed number of sheets from among the plurality of waste documents placed in each of the compartments, the engaging members being adapted to convey these sheets to an inlet 40. The engaging members 42 constitute a portion of a paper feed mechanism 43, the height h of the projecting portion 42*a* of each engaging member preferably being set beforehand to a value corresponding to the number of sheets which is desired to be fed at one time. This can be more easily understood from FIG. 4. The engaging members are fixed to a movable arm 44 by bolts or any other suitable means. Movable arm 44 is fixed to a chain 48 via a bracket 46, the chain being driven by a pair of gears 50 that rotate in unison with a drive shaft 52.

Referring now to FIG. 3, recesses 21*b* are formed in platform 21, and recesses 22*a*, 22*b* are formed in the respective front and back walls of the stand-by chamber 22. Projecting portions corresponding to the partitioning members engage with recesses 21*b*, 22*a* and 22*b* such that the partitioning members can be detachably secured at prescribed positions. Provided on both sides of stand-by chamber 22 are storage chambers 51 for accommodating the partitioning members 24, 26, 28.

If it is assumed that A6 or B6-size sheets have been placed in each of the compartments shown in FIGS. 1 and 2, removing the partitioning members 24, 28 makes it possible to place B5 for A5-size sheets on either side of the remaining partitioning member 26. It is also possible to place B4 or A4-size sheets in the approximate center of the stand-by chamber if partitioning member 26 is removed. Stand-by chamber 22 can thus be freely divided into compartments of an appropriate width by combining partitioning members 24, 26, 28 according to the sizes of the waste documents which are to be processed. Any unnecessary partitioning members are placed and stored in chambers 51 from which they can be removed when required.

Figure 6:
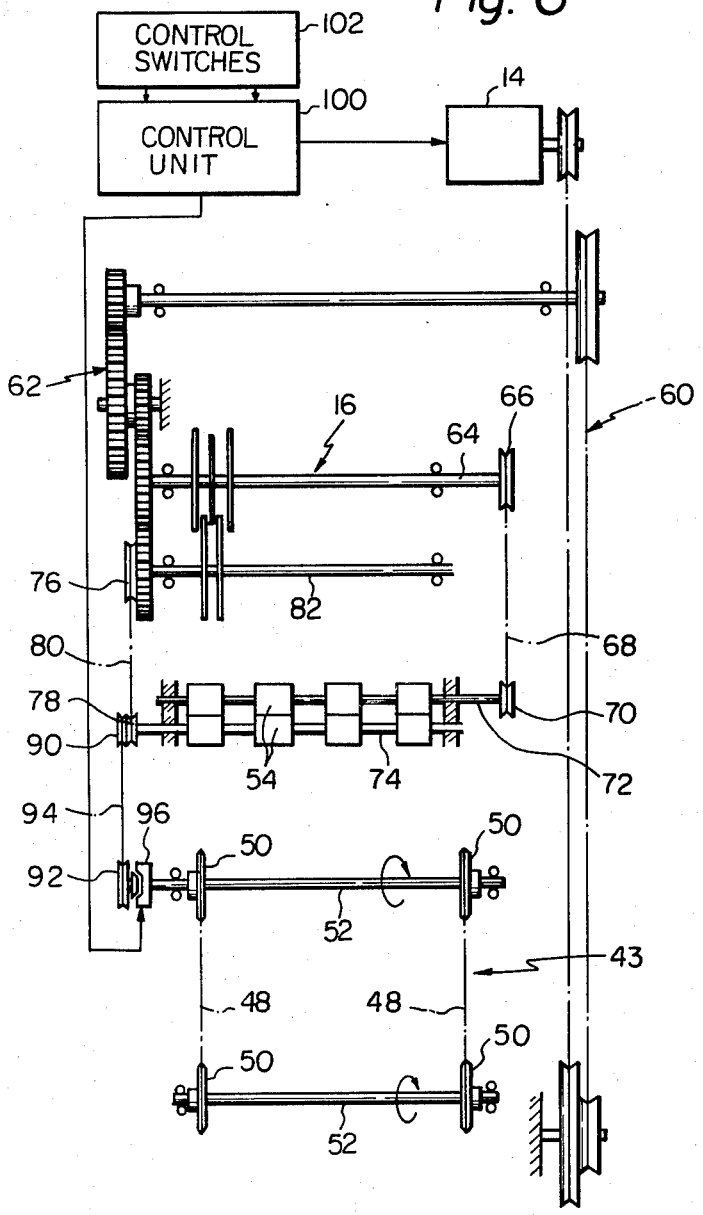
FIG. 6 is a simplified view of the document shredder drive system according to the present invention.

FIG. 6 illustrates an example of a drive system of the automatic document shredder according to the present invention. A drive motor 14 drives the shredding section 16 through a first reduction stage 60 comprising means such as pulleys and belts, and second reduction stage 62 comprising a plurality of gears. Supported at one end of a rotary shaft 64 of the shredding section 16 is a pulley 16 that rotates one rotary shaft 72 of guide rollers 54 through a belt 68 and pulley 70. The other rotary shaft 74 of the guide rollers is driven by rotary shaft 82 of shredding section 16 through pulleys 76, 78 and belt 80. The power transmitted to rotary shaft 74 is further transmitted to rotary shaft 52 of paper feed mechanism 43 through pulleys 90, 92, belt 94 and clutch means 96 such as a magnetic clutch or the like. The engagement and disengagement of clutch means 96 is controlled in response to a control signal S from a control device 100 operated by a control switch 102. Control device 100 is designed to disengage clutch means 96 by producing a low level control signal S when a manual switch is operated, and is further adapted to engage clutch means 96 by issuing a high level control signal S when an automatic switch is operated.

In operation, a plurality of sheets to be processed are disposed in each of the compartments 30, 32, 34, 36 which are formed by detachable partitioning members 24, 26, 28 in stand-by chamber 22, as shown in FIGS. 1 and 2. When the automatic control switch is operated, motor 14 starts and clutch means 96 is engaged by control signal S to rotate rotary shaft 50 in the manner described with reference to FIG. 6. At this time the engaging members 44 of paper feed mechanism 43 rotate counter-clockwise in FIG. 3 and feed a prescribed number of sheets, from those disposed in each of the compartments, batch-wise toward the guide rollers 54 so that the sheets are grasped and held between the guide rollers and forcedly supplied to the shredding section 16. The engaging members 42 of the paper feed mechanism 43 now simultaneously engage with the paper sheets in each of the compartments and automatically supply a large number of sheets to the shredding section at one time to markedly improve processing efficiency.

When it is desired to feed the waste documents manually, any one or all of the partitioning members 24, 26, 28 is removed and placed in chamber 51. Next, operating the manual switch actuates guide rollers 54 and shredding mechanism 16 so that a prescribed number of waste document sheets can be supplied batch-wise from inlet 40 to shredding section 16 via the guide rollers 56. At this time the engaging members 42 of paper feed mechanism 43 are non-operative so that the documents can be safely shredded without the fingers of the operator coming into contact with the engaging members 42.

It will now be apparent from the foregoing description that according to the present invention the stand-by chamber can be freely partitioned by the plurality of detachable partitioning member into a number of compartments corresponding to the sizes of the waste documents intended for destruction. This makes it possible to simultaneously feed a prescribed number of sheets from the plurality of compartments to the shredding section in a batch-wise manner, thereby greatly enhancing the efficiency at which the waste documents are shredded. Furthermore, the fact that the wast documents can be fed to the shredding section in an automatic manner is a major advantage since the shredder does not occupy a large portion of the operator's time.

While the present invention has been illustrated and described with reference to a particular preferred embodiment, it should be understood that the present invention is in no way limited by this embodiment but can be subjected to various changes and modifications. For example, the engaging members 42 may be provided as projections on a drum or endless belt.

What is claimed is:

1. A document shredder for shredding waste documents into unintelligible form, comprising:

a casing;

means in said casing for shredding said waste document into said unintelligible form;

stand-by chamber means provided in said casing for accommodating a plurality of said waste documents to be shredded, said plurality of waste documents being placed in said stand-by chamber in a stacked condition prior to said shredding;

at least one partitioning member detachably disposed in said stand-by chamber means to divide said stand-by chamber means into a plurality of compartments corresponding to the sizes of said waste documents; and an automatic feeding mechanism for automatically and simultaneously feeding a prescribed number of sheets of said waste documents from each of said plurality of compartments to said shredding means in a batch-wise manner;

said stand-by chamber means and said automatic feeding mechanism being provided within an upper portion of said casing.

2. A document shredder according to claim 1, further comprising a pair of guide rollers for forcibly feeding said predetermined number of sheets to said shredding means from said automatic feeding mechanism.

3. A document shredder according to claim 1, in which said stand-by chamber means comprises a bottom member including a platform upon which said waste documents are stacked, said platform having a plurality of elongated slots formed therein extending in a direction parallel to said partitioning member for guiding said feeding mechanism, with at least one of said elongated slots being provided in each of said plurality of compartments.

4. A document shredder according to any of claims 1, 2 or 3, further comprising at least one storage chamber for accommodating said partitioning member when said partitioning member is not being utilized for partitioning said stand-by chamber.

5. A document shredder according to claim 4, in which said at least one storage chamber is located within said casing to at least one side of said stand-by chamber means.

6. A document shredder for shredding documents into unintelligible form comprising, in combination:

a casing;

means in said casing for shredding said waste documents into said unintelligible form;

stand-by chamber means provided in said casing for accommodating a plurality of said waste documents to be shredded, said plurality of waste documents being placed on a platform comprising a lower member of said stand-by chamber means in a stacked condition prior to shredding;

a plurality of partitioning members detachably disposed in said stand-by chamber means to divide said stand-by chamber means into a plurality of compartments corresponding to the sizes of said waste documents;

an automatic feeding mechanism for automatically and simultaneously feeding a prescribed number of sheets of said waste documents from each of said plurality of compartments in a batchwise manner, said automatic feeding mechanism including a plurality of engaging members projecting into said stand-by chamber means, with each of said engaging members being driven by said automatic feeding mechanism to engage said prescribed number of sheets of said waste documents to be fed from each of said compartments.

7. A document shredder for shredding waste documents into unintelligible form comprising, in combination:

a casing;

means in said casing for shredding said waste documents into said unintelligible form;

stand-by chamber means provided in said casing for accommodating a plurality of said waste documents to be shredded, said plurality of waste documents being placed on a platform comprising a lower member of said stand-by chamber means in a stacked condition prior to shredding;

a plurality of partitioning members detachably disposed in said stand-by chamber means to divide said stand-by chamber means into a plurality of compartments corresponding to the sizes of said waste documents; and an automatic feeding mechanism for automatically feeding a prescribed number of sheets of said waste documents from each of said plurality of compartments to said shredding means in a batchwise manner, said automatic feeding mechanism including a plurality of engaging members, said platform having a plurality of elongated slots therein, each of said engaging members protruding through one of said elongated slots provided in said platform into said stand-by chamber means and driven by said automatic feeding mechanism in a direction guided by said elongated slot to forcibly feed said prescribed number of sheets of documents towards said shredding means, with at least one of said elongated slots having one of said engaging members protruding therethrough being provided in each of said plurality of compartments.

* * * * *